US005943738A

United States Patent [19]

Karfiol

[11] Patent Number: 5,943,738

[45] Date of Patent: Aug. 31, 1999

[54] FRICTION HINGE WITH RETENTION FINGER

[75] Inventor: Yury Karfiol, Brooklyn, N.Y.

[73] Assignee: TorqMaster, Inc., Stamford, Conn.

[21] Appl. No.: 09/002,764

[22] Filed: Jan. 6, 1998

[51] Int. Cl.[6] ..... E05D 5/12; E05D 11/08

[52] U.S. Cl. ..... 16/342; 16/381

[58] Field of Search ..... 16/342, 380, 381; 296/97.12

[56] References Cited

U.S. PATENT DOCUMENTS

| | | | |
|---|---|---|---|
| Re. 12,139 | 8/1903 | Sloan | 16/342 |
| 1,728,433 | 9/1929 | Mohun | 16/380 |
| 2,997,734 | 8/1961 | Dyer | 16/381 |
| 3,349,430 | 10/1967 | Rosenvold et al. | 16/381 |
| 4,135,273 | 1/1979 | Holmes | 16/381 |
| 5,079,799 | 1/1992 | Rude et al. | 16/342 |
| 5,231,734 | 8/1993 | Rude | 16/342 |
| 5,251,949 | 10/1993 | Miller et al. | 296/97.12 |
| 5,406,678 | 4/1995 | Rude et al. | 16/342 |
| 5,666,695 | 9/1997 | Jegers et al. | 16/381 |
| 5,722,121 | 3/1998 | Lau et al. | 16/381 |

*Primary Examiner*—Chuck Y. Mah
*Assistant Examiner*—Donald M. Gurley
*Attorney, Agent, or Firm*—Gottlieb, Rackman & Reisman, P.C.

[57] ABSTRACT

A friction hinge is provided, comprising a shaft and a band frictionally wrapped about the shaft, wherein the band is formed with a pair of annular slits for defining a pair of outside annular members and an inside annular finger disposed between the slits, the finger being circularly wrapped about the shaft such that the finger is matingly received within an annular undercut formed along the shaft.

7 Claims, 2 Drawing Sheets

FRICTION HINGE WITH RETENTION FINGER

BACKGROUND OF THE INVENTION

Simple friction hinges can be made with only two parts, a band fit tightly about a shaft. However, in many instances in which hinges are used to connect parts rotatably together, there are axial forces acting on the hinges. Absent some features to insure axial positioning, the band and the shaft of the friction hinge(s) may tend to come apart or be jammed together, causing a failure. In these cases, it is necessary to assure that the band and the shaft remain in the proper axial alignment with respect to one another. Two lock-rings are often used to solve this problem. A flanges on the shaft, together with a single lock-ring or heading of the shaft after assembly are also used. These prior art solutions to this problem involve extra operations and/or extra parts, all of which add cost and complexity to the manufacturing of the friction hinge.

SUMMARY OF THE INVENTION

Our invention provides a very simple method for axially positioning the band with respect to the shaft. It requires a single undercut in the shaft, and two slots or other simply achieved cuts in the band. No extra parts are required, and no extra steps are needed in assembly.

DETAILED DESCRIPTION OF THE DRAWINGS

Figure 1:
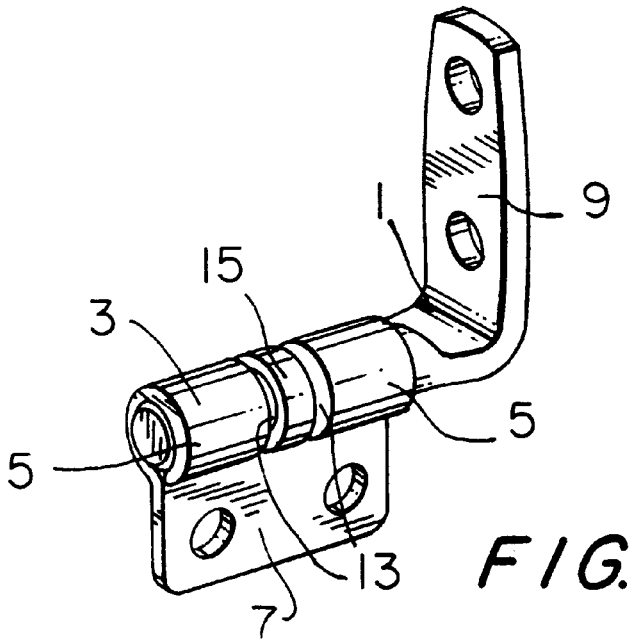
FIG. 1 is a projection view of the assembled friction hinge of our invention.
Figure 2:
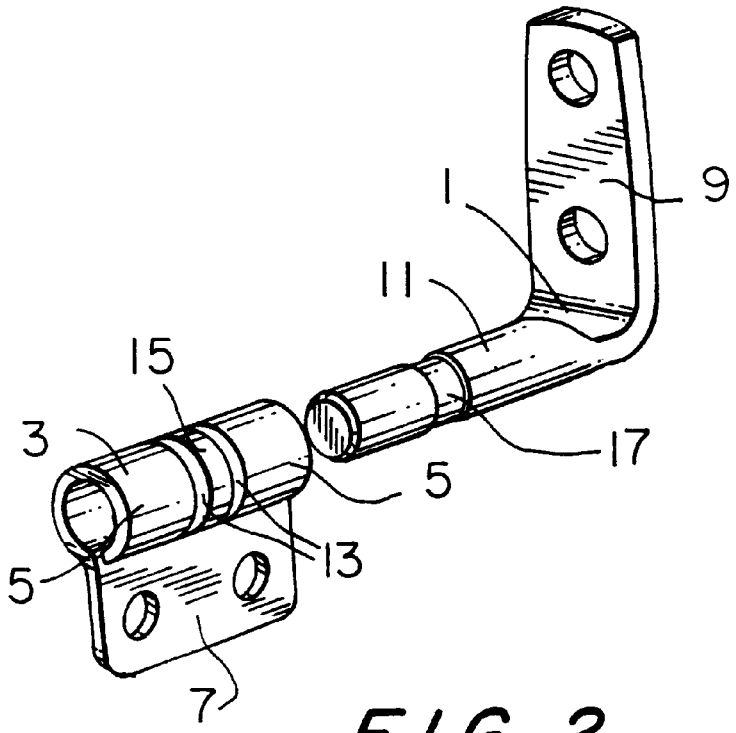
FIG. 2 is an exploded projection view of the two component parts of our invention.

The friction hinge of FIGS. 1 and 2 have only two parts, shaft 1 and band 3. Band 3 has a portion 5 that is essentially circular, and flange portion 7 for attachment. Shaft 1 has flattened portion 9 for mounting, and cylindrical portion 11 for receiving circular portion 5 of band 3.

Circular portion 5 is formed with a diameter slightly smaller than the outside diameter of shaft 1. Therefore, band 3 must be expanded slightly in order to fit over shaft 1. This produces a moment in circular portion 5 of band 3, and the grip of circular portion 5 on cylindrical portion 11 of shaft 1 produces the desired friction.

The band of our invention is cut from flat material. During the cutting operation, two slits 13 are cut into the band, forming finger 15 therebetween. When circular portion 5 of the band is formed into an essentially circular shape, finger 15 is formed into that shape along with the rest of the band material.

Shaft 1 has undercut 17 in cylindrical portion 11 positioned and sized to receive finger 15. Since circular portion 5 of band 3 is formed to a diameter somewhat smaller than the outside diameter of cylindrical portion 11 of shaft 1, when the two parts are assembled and finger 15 is positioned over undercut 17, the stored moment in finger 15 causes it to move into undercut 17. Finger 15 should fit loosely into undercut 17, and undercut 17 should, desirably, be deep enough so that finger 15 does not contact the bottom of the undercut so as to minimize any spurious effects on the frictional torque of the hinge.

The axial retention force for this embodiment of our invention depends on the amount of interference between the band and the shaft. That is, the amount by which the band must be expanded to fit over the shaft. It also depends on the diameter used, and the thickness and elastic properties of the band material, and on the arcuate length of slits 13. The width, in the axial direction, of slits 13 is not important. But it is important to remove some material to prevent rubbing contact between the finger and the band portions adjacent to the slits.

Figure 3:
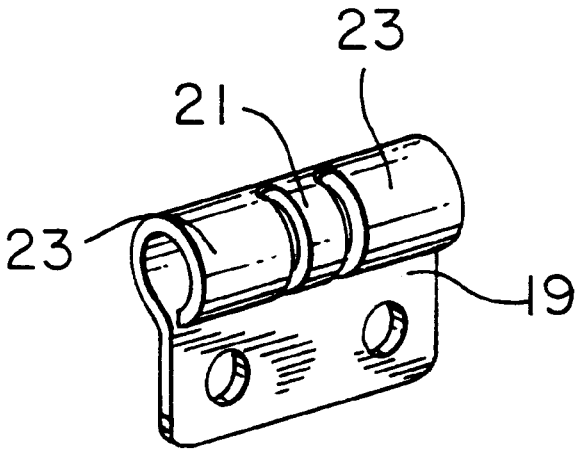
FIG. 3 is a projection view of an alternate embodiment of the band of our invention.

Experience has shown that sufficient axial retention can be achieved for many friction hinge applications by means of the above embodiment. However, a second embodiment of our invention provides greater axial retention capability than that provided by the above embodiment. FIG. 3 depicts the band of this embodiment. Band 19, of this second embodiment, is of the same general configuration as band 3 of the previous embodiment. In fact, band 19 can be cut from sheet material with the same tool used to cut band 3. The only difference between the two bands is in the tool used to form the circular portion of the bands. Band 3 is formed to a uniform, essentially circular shape, whereas for band 19, finger 21 is formed to a smaller diameter than the two circular portions 23. This requires somewhat more complex forming tooling or operations. But once tooled, the manufacturing expense is no greater.

When band 19 is assembled onto a shaft like shaft 1, there will be more engagement between finger 21 and the undercut in the shaft than in the first embodiment. This produces greater axial retention capability.

Care should be taken to ensure that the shaft undercut is deep enough to accommodate the finger.

Figure 4:
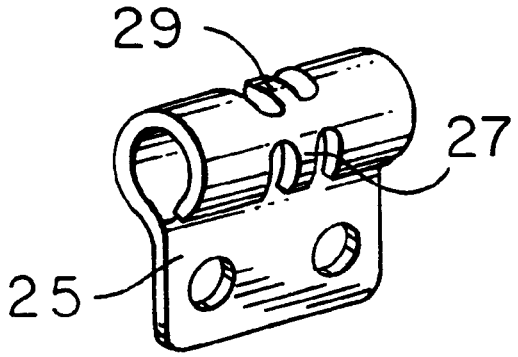
FIG. 4 is a projection view of a third embodiment of the band of our inventive friction hinge.

Still another embodiment of the band of our inventive friction hinge is shown in FIG. 4. Axial retention by a single finger protruding into an undercut in the shaft may fail in the presence of large forces in the axial direction. As the shaft turns within the band in the direction in which the band is wrapped about the shaft, axial forces bring the edges of the undercut against an edge of the finger as it enters the undercut tending to raise the finger out of the undercut. If the forces and the rotation persist, the finger may be lifted out of the undercut and onto the large diameter of the shaft. Band 25 of FIG. 4 overcomes this problem by means of having two fingers, one facing in each direction within the same shaft undercut. Finger 27 faces in the same direction as the fingers of the previous embodiments, and finger 29 faces in the opposite direction. The use of a finger facing in each direction tends to prevent the lifting out of the finger under large axial loads for one direction of rotation.

I claim:

1. A friction hinge comprising:

a shaft and a substantially circular radially expandable band frictionally wrapped thereabout;

said band defined by a first portion leading to one end and a second portion leading to the other opposite end with said first portion formed with a pair of slits extending from its respective end such that said first portion comprises a pair of substantially circularly radially expandable outside members and a substantially circular inside finger disposed between said slits and attached to said second portion;

said outside members and said finger having substantially the same circular diameter when said outside members are not in a condition of radial expansion;

said shaft having an annular undercut aligned with said finger;

said outside members and said finger having a circular diameter slightly smaller than that of said shaft such that said outside members radially expand to frictionally grip said shaft while said finger is received in said undercut.

2. The hinge of claim 1, wherein said finger, after assembly, fits loosely in said annular undercut formed in said shaft.

3. The hinge of claim 1, wherein said annular undercut formed in said shaft has a bottom and said finger does not substantially contact said bottom when matingly received in said undercut.

4. A friction hinge comprising:

a shaft and a substantially circular radially expandable band frictionally wrapped thereabout;

said band having a flange portion and a substantially circular finger extending from said flange portion and coaxial with said band;

said band and said finger having substantially the same circular diameter when said band is not in a condition of radial expansion;

said shaft having an annular undercut aligned with said finger;

said band having a circular diameter slightly smaller than that of said shaft such that said band radially expands to frictionally grip said shaft while said finger is received by said undercut.

5. The hinge of claim 1, wherein said finger, after assembly, fits loosely in said annular undercut formed in said shaft.

6. The hinge of claim 4, wherein said annular undercut formed in said shaft has a bottom, and said finger does not substantially contact said bottom when matingly received in said undercut.

7. The hinge of claim 4, wherein said band is formed with at least one annular slit for defining said finger.

* * * * *